US009845519B2

(12) United States Patent
Matsumoto et al.

(10) Patent No.: US 9,845,519 B2
(45) Date of Patent: Dec. 19, 2017

(54) BORON-ADDED HIGH STRENGTH STEEL FOR BOLT AND HIGH STRENGTH BOLT HAVING EXCELLENT DELAYED FRACTURE RESISTANCE

(71) Applicant: Kobe Steel, Ltd., Kobe-shi (JP)

(72) Inventors: Yosuke Matsumoto, Kobe (JP); Atsushi Inada, Kobe (JP); Masamichi Chiba, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 423 days.

(21) Appl. No.: 14/388,361

(22) PCT Filed: Feb. 5, 2013

(86) PCT No.: PCT/JP2013/052613

§ 371 (c)(1),
(2) Date: Sep. 26, 2014

(87) PCT Pub. No.: WO2013/145868

PCT Pub. Date: Oct. 3, 2013

(65) Prior Publication Data

US 2015/0053315 A1 Feb. 26, 2015

(30) Foreign Application Priority Data

Mar. 26, 2012 (JP) ..... 2012-070205
Sep. 24, 2012 (JP) ..... 2012-209869

(51) Int. Cl.

| | |
|---|---|
| ***C21D 9/00*** | (2006.01) |
| ***C22C 38/32*** | (2006.01) |
| ***C21D 1/25*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/28*** | (2006.01) |
| ***C21D 1/18*** | (2006.01) |
| ***C21D 6/00*** | (2006.01) |
| ***C21D 6/02*** | (2006.01) |
| ***C22C 38/12*** | (2006.01) |
| ***C22C 38/14*** | (2006.01) |
| ***C22C 38/38*** | (2006.01) |

(52) U.S. Cl.

CPC ..... *C21D 9/0093* (2013.01); *C21D 1/18* (2013.01); *C21D 1/25* (2013.01); *C21D 6/002* (2013.01); *C21D 6/005* (2013.01); *C21D 6/008* (2013.01); *C21D 6/02* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/28* (2013.01); *C22C 38/32* (2013.01); *C22C 38/38* (2013.01); *C21D 2211/004* (2013.01); *C21D 2211/005* (2013.01); *C21D 2211/009* (2013.01)

(58) Field of Classification Search

CPC . C21D 1/18; C21D 1/25; C21D 6/002; C21D 6/005; C21D 6/008; C21D 6/02; C21D 9/0093; C21D 2211/004; C21D 2211/005; C21D 2211/009; C22C 38/001; C22C 38/002; C22C 38/02; C22C 38/04; C22C 38/06; C22C 38/12; C22C 38/14; C22C 38/22; C22C 38/24; C22C 38/28; C22C 38/32; C22C 38/38

See application file for complete search history.

(56) References Cited

U.S. PATENT DOCUMENTS

| | | | |
|---|---|---|---|
| 2003/0098104 | A1 | 5/2003 | Tsuchida et al. |
| 2007/0017610 | A1 | 1/2007 | Yoshida et al. |
| 2008/0264524 | A1 | 10/2008 | Maruta et al. |

(Continued)

FOREIGN PATENT DOCUMENTS

| | | | |
|---|---|---|---|
| CN | 1900344 | A | 1/2007 |
| CN | 101243197 | A | 8/2008 |

(Continued)

OTHER PUBLICATIONS

Lee et al., English machine translation of KR 2008-0058949, Jun. 2008, p. 1-14.*

(Continued)

*Primary Examiner* — Roy King
*Assistant Examiner* — Caitlin Kiechle
(74) *Attorney, Agent, or Firm* — Oblon, McClelland, Maier & Neustadt, L.L.P.

(57) ABSTRACT

Provided are: a boron-added high strength steel for bolt excellent in delayed fracture resistance even having a tensile strength of 1100 MPa or more without addition of large amounts of expensive alloy elements such as Cr and Mo: and a high strength bolt made from the boron-added high strength steel for bolt. The high strength steel for bolt contains C of 0.23% to less than 0.40%, Si of 0.23% to 1.50%, Mn of 0.30% to 1.45%, P of 0.03% or less (excluding 0%), S of 0.03% or less (excluding 0%), Cr of 0.05% to 1.5%, V of 0.02% to 0.30%, Ti of 0.02% to 0.1%, B of 0.0003% to 0.0050%, Al of 0.01% to 0.10%, and N of 0.002% to 0.010%, with the remainder being iron and inevitable impurities. The steel has a ratio ([Si]/[C]) of the Si content [Si] to the C content [C] of 1.0 or more and has a ferrite-pearlite mixed microstructure.

4 Claims, 1 Drawing Sheet

(56) References Cited

U.S. PATENT DOCUMENTS

| | | | |
|---|---|---|---|
| 2012/0060979 | A1 | 3/2012 | Kozawa et al. |
| 2012/0298262 | A1 | 11/2012 | Hirakami et al. |
| 2013/0340895 | A1 | 12/2013 | Kozawa et al. |

FOREIGN PATENT DOCUMENTS

| | | | |
|---|---|---|---|
| CN | 101935806 | A | 1/2011 |
| EP | 1 956 108 | A1 | 8/2008 |
| JP | 58-011764 | A | 1/1983 |
| JP | 61-217553 | A | 9/1986 |
| JP | 02-085342 | A | 3/1990 |
| JP | 04-173922 | A | 6/1992 |
| JP | 05-239589 | A | 9/1993 |
| JP | 05-255803 | A | 10/1993 |
| JP | 10-287957 | A | 10/1998 |
| JP | 11-043738 | A | 2/1999 |
| JP | 11-229090 | A | 8/1999 |
| JP | 2000-73138 | A | 3/2000 |
| JP | 2000-119806 | A | 4/2000 |
| JP | 2000-336460 | A | 12/2000 |
| JP | 2001-107139 | A | 4/2001 |
| JP | 2003-321743 | A | 11/2003 |
| JP | 3490293 | B2 | 1/2004 |
| JP | 3535754 | B2 | 6/2004 |
| JP | 2005-133152 | A | 5/2005 |
| JP | 2006-291237 | A | 10/2006 |
| JP | 2007-31734 | A | 2/2007 |
| JP | 2007-146284 | A | 6/2007 |
| JP | 2007-217718 | A | 8/2007 |
| JP | 2008-261055 | A | 10/2008 |
| JP | 2009-293070 | A | 12/2009 |
| JP | 2010-121191 | | 6/2010 |
| JP | 2010-242170 | A | 10/2010 |
| JP | 2010-285689 | A | 12/2010 |
| KE | 10-2008-0058949 | A | 6/2008 |
| KR | 10-2008-0017365 | A | 2/2008 |
| TW | I 332032 | B | 10/2010 |
| WO | WO 01/75186 | A1 | 10/2001 |
| WO | WO 2007/052775 | A1 | 5/2007 |
| WO | WO 2011/062012 | A1 | 5/2011 |
| WO | WO 2011/108459 | A1 | 9/2011 |
| WO | WO 2011/111873 | A1 | 9/2011 |

OTHER PUBLICATIONS

"Carbon and Alloy Steels", Modern Steels and Their Properties, Mar. 1980, Bethlehem Steel Corporation, p. 19-23.*

International Search Report and Written Opinion dated May 7, 2013 in PCT/JP2013/052613 filed Feb. 5, 2013.

Yao GuiSheng et al., "Practical Technique for Automobile Steel", China Machine Press, Sep. 2015, 16 pages http://img.duxiu.com/n/print.jsp (with English translation).

Extended European Search Report dated Mar. 3, 2016 in European Patent Application No. 13767370.3.

* cited by examiner

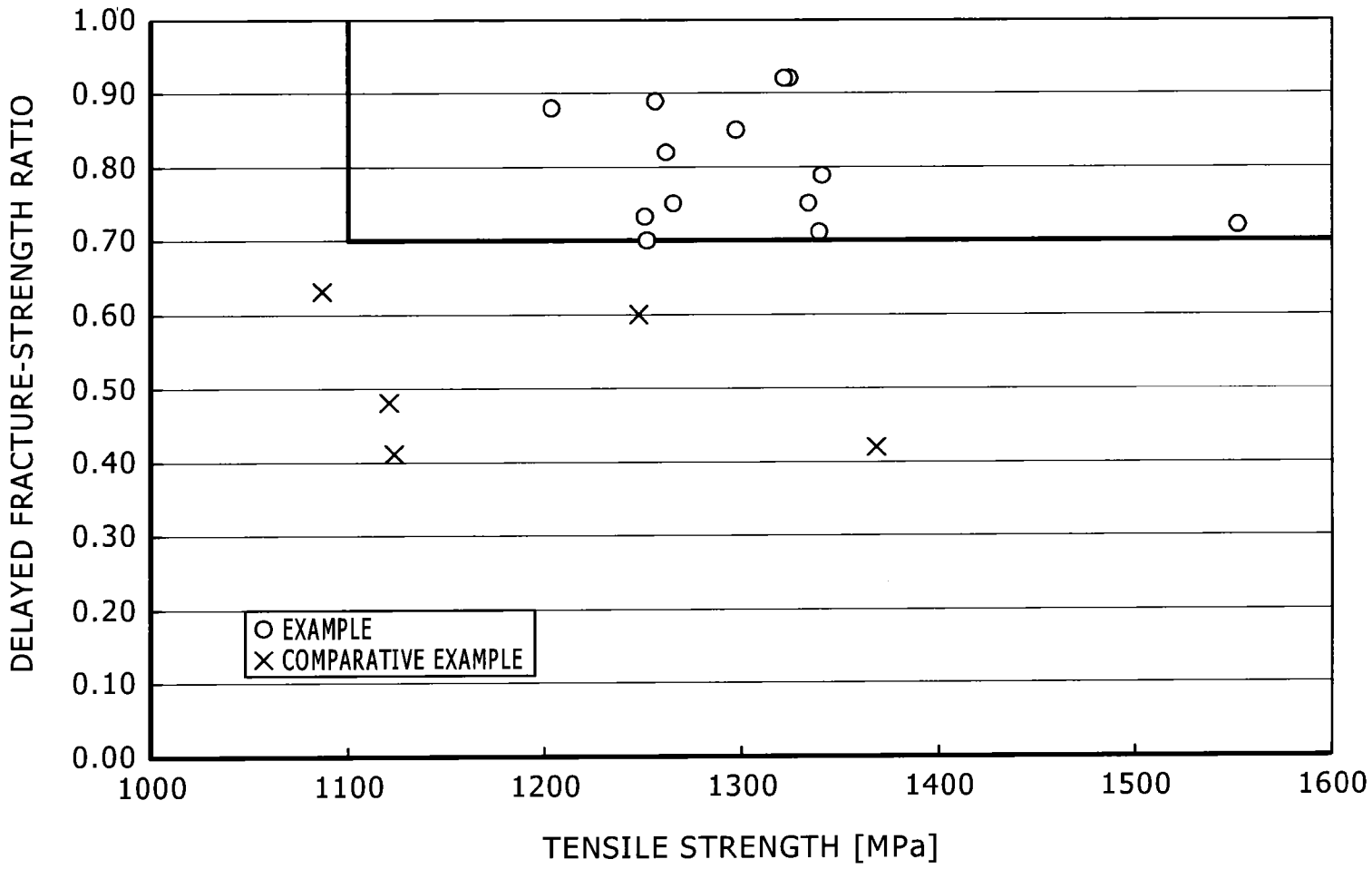
DELAYED FRACTURE-STRENGTH RATIO
1.00
0.90
0.80
0.70
0.60
0.50
0.40
0.30
0.20
0.10
0.00
1000
1100
1200
1300
1400
1500
1600
TENSILE STRENGTH [MPa]
O EXAMPLE
X COMPARATIVE EXAMPLE

BORON-ADDED HIGH STRENGTH STEEL FOR BOLT AND HIGH STRENGTH BOLT HAVING EXCELLENT DELAYED FRACTURE RESISTANCE

TECHNICAL FIELD

The present invention relates to steels for bolts and high strength bolts using the steels, which are used for automobiles and various industrial machines. Specifically, the present invention relates to a boron-added high strength steel for bolt and a high strength bolt, both of which exhibit excellent delayed fracture resistance even having a tensile strength of 1100 MPa or more.

BACKGROUND ART

Material steels for bolts having a tensile strength less than 1100 MPa are now replaced from standardized steels to boron-added steels so as to have lower cost. However, SCM steels (chromium molybdenum steels) and other standardized steels are still heavily used for bolts having a higher tensile strength of 1100 MPa or more. The SCM steels contain large amounts of alloy elements such as Cr and Mo. Demands are increasingly made to provide SCM-alternate steels containing lower amounts of Cr and Mo so as to reduce the steel cost. Simple reduction of alloy elements, however, may hardly help steels to offer a strength and delayed fracture resistance both at satisfactory levels.

Under such circumstances, boron-added steels have been considered as materials for high strength bolts, because the boron-added steels effectively offer better hardenability by the addition of boron. The boron-added steels, however, offer significantly inferior delayed fracture resistance with an increasing strength, and it is difficult to apply them to a portion in a severe use environment.

A variety of technologies for the improvement of delayed fracture resistance has been proposed. Typically, Patent literature (PTL) 1 proposes a steel having better delayed fracture resistance by specifying the contents of elements such as V, N, and Si. Simple specification in the element contents, however, difficulty help the steel to have a strength, delayed fracture resistance, and corrosion resistance all at satisfactory levels.

PTL 2 proposes a bainitic steel having small unevenness in mechanical properties. The bainitic steel, however, is hardly applicable to a bolt because the bainitic phase causes the steel to have inferior wire drawability and cold forgeability.

PTL 3 proposes a case-hardening boron-added steel having little heat treatment strain. The case-hardening boron-added steel, however, is hardly applicable to a bolt because the steel, when undergoing carburizing and quenching, has a higher hardness in its surface layer and offers significantly inferior delayed fracture resistance.

PTL 4 and PTL 5 propose technologies for refining grains so as to offer better delayed fracture resistance. The steels, however, are hardly applicable to a severer environment when the steels enjoy the effects of grain refinement alone.

All the technologies previously proposed for better delayed fracture resistance are disadvantageous in at least one of strength, delayed fracture resistance in a severe environment, and manufacturing.

CITATION LIST

Patent Literature

PTL 1: Japanese Unexamined Patent Application Publication (JP-A) No. 2007-217718

PTL 2: JP-A No. H05-239589
PTL 3: JP-A No. S61-217553
PTL 4: Japanese Patent No. 3535754
PTL 5: Japanese Patent No. 3490293

SUMMARY OF INVENTION

Technical Problem

The present invention has been made under these circumstances, and an object thereof is to provide: a boron-added high strength steel for bolt which has excellent delayed fracture resistance even having a tensile strength of 1100 MPa or more without the addition of large amounts of expensive alloy elements such as Cr and Mo; and a high strength bolt made from the boron-added high strength steel for bolt.

Solution to Problem

The present invention achieves the objects and provides, in an embodiment, a boron-added high strength steel for bolt containing: C in a content (in mass percent, hereinafter the same) of 0.23% to less than 0.40%; Si in a content of 0.23% to 1.50%; Mn in a content of 0.30% to 1.45%; P in a content of 0.03% or less (excluding 0%); S in a content of 0.03% or less (excluding 0%); Cr in a content of 0.05% to 1.5%; V in a content of 0.02% to 0.30%; Ti in a content of 0.02% to 0.1%; B in a content of 0.0003% to 0.0050%; Al in a content of 0.01% to 0.10%; and N in a content of 0.002% to 0.010%, with the remainder being iron and inevitable impurities; the steel having a ratio ([Si]/[C]) of the Si content [Si] to the C content [C] of 1.0 or more; and the steel having a mixed microstructure of ferrite and pearlite.

As used herein the term "ferrite-pearlite microstructure" (microstructure as a mixture of ferrite and pearlite phases) refers to a microstructure including both ferrite and pearlite phases. The ferrite-pearlite microstructure may further include a trace amount of any of other phases such as bainite. The content of phases other than ferrite and pearlite is not greater than 10 percent by area.

The boron-added high strength steel for bolt according to the embodiment of the present invention may effectively further contain Mo in a content of 0.10% or less (excluding 0%) according to necessity. The boron-added high strength steel for bolt, when containing Mo, may have still better properties.

The present invention further provides, in another embodiment, a high strength bolt which is obtained by forming a bolt-shaped workpiece using the steel as mentioned above (the boron-added high strength steel for bolt); subjecting the bolt-shaped workpiece to a quenching treatment while heating the workpiece to 850° C. to 920° C.; and subjecting the bolt-shaped workpiece after quenching to a tempering treatment.

In addition and advantageously, the present invention provides a high strength bolt which is obtained by forming a bolt-shaped workpiece using the steel as mentioned above (the boron-added high strength steel for bolt); subjecting the bolt-shaped workpiece to a quenching treatment; and subjecting the bolt-shaped workpiece after quenching to a tempering treatment, in which a VI value is 10% or more, where the VI value is determined from a V content in precipitates having a particle size of 0.1 μm or more and a V content in the steel and specified by Expression (1) given as follows:

$$VI\ \text{value}(\%)=[(V\ \text{content in precipitates having a particle size of 0.1 μm or more})/(V\ \text{content in the steel})]\times 100 \quad (1).$$

In the high strength bolt according to the embodiment of the present invention, an austenitic grain size number of a bolt shank after quenching and tempering is preferably 8 or more.

Advantageous Effects of Invention

The present invention strictly specifies the chemical composition and controls the ratio ([Si]/[C]) of the Si content to the C content within an appropriate range. This can therefore practically provide a boron-added high strength steel for bolt exhibiting excellent delayed fracture resistance even in a severe environment, and the steel, when used, can provide a high strength bolt having excellent delayed fracture resistance.

BRIEF DESCRIPTION OF DRAWINGS

FIG. 1 is a graph illustrating how the ratio [Si]/[C] affects the tensile strength and delayed fracture-strength ratio.

DESCRIPTION OF EMBODIMENTS

The present inventors made intensive investigations on boron-added steels that exhibit excellent delayed fracture resistance without the addition of large amounts of expensive alloy elements such as Mo and Cr even when having a high tensile strength of 1100 MPa or more. As a result, the present inventors have found that not the addition of alloy elements, but the minimization of C content is very effective for a boron-added steel having a tensile strength of 1100 MPa or more to ensure certain delayed fracture resistance. Specifically, the present inventors have found that the reduction in C content may lead to an insufficient strength, but the reduction in strength due to the reduction in C content can be sufficiently supplemented by adapting the Si content to be equal to or greater than the C content (namely, by controlling the ratio ([Si]/[C]) of the Si content to the C content to be 1.0 or more.

The present inventors have also found that the reduction in C content also contributes to better corrosion resistance, but austenitic grain refinement by containing carbide/nitride-forming elements such as V and Ti is effective for the steel to ensure sufficient delayed fracture resistance in a severe environment, in addition to the control of the Si content to be equal to or greater than the C content; and that a boron-added steel having excellent delayed fracture resistance even having a tensile strength of 1100 MPa or more can be achieved further by controlling other chemical compositions (other elements). The present invention has been achieved based on these findings. As used herein the term "carbide/nitride" refers to and includes at least one selected from the group consisting of "carbide", "nitride" and "carbonitride". Where necessary, the steel according to the embodiment of the present invention may be subjected to a spheroidization treatment before bolt forming.

Carbon (C) element is effective for the steel to ensure a certain strength, but, if contained in a higher content, may often cause the steel to have inferior toughness and corrosion resistance to thereby be more susceptible to delayed fracture. In contrast, silicon (Si) element is also effective for the steel to ensure a certain strength, but how this element affects delayed fracture has not yet been clarified. The present inventors have made investigations on how Si affects delayed fracture. As a result, they have found that the steel can have a tensile strength of 1100 MPa or more, toughness, and corrosion resistance all at satisfactory levels by controlling the Si content to be equal to or higher than the C content; and that the steel can thereby have a tensile strength and delayed fracture resistance both at high levels in good balance.

Specifically, a steel, if intended to have a tensile strength of 1100 MPa or more by the addition of carbon alone, may have inferior corrosion resistance and become more susceptible to delayed fracture, because hydrogen is evolved in a larger amount in the steel surface and, as a result, migrates into the steel in a larger amount. Assume that elements offering grain refinement effects, such as Ti and V, are added to the steel so as to offer better toughness. The steel in this case, however, fails to enjoy sufficiently effective improvements. This is because vanadium carbide is liable to be dissolved upon heating in quenching, and vanadium, even if added, less effectively contributes to grain refinement. In addition, carbon in such a higher content significantly adversely affects the corrosion resistance.

In contrast, a steel containing both carbon and silicon can have a relatively low C content because it can have a higher strength by the presence of Si. Specifically, the steel can have excellent corrosion resistance and delayed fracture resistance and still ensure a tensile strength of 1100 MPa or more by containing carbon in the matrix in a lower content but containing silicon in a higher content so as to ensure a certain strength. This is because Si does not significantly affect the corrosion resistance of steel. The steel can have still better toughness because the matrix has better toughness because containing C in a lower content and further containing elements having grain refinement effects, such as Ti and V.

Silicon (Si) is enriched around carbides typically of V and Ti and thereby advantageously suppresses carbon diffusion (migration). This helps the carbides of V and Ti to be less soluble upon quenching and to further advantageously exhibit pinning effects. Thus, grain refinement can be further accelerated.

Based on this, the boron-added steel for bolt according to the embodiment of the present invention should have a ratio ([Si]/[C]) of the Si content [Si] to the C content [C] of 1.0 or more. This enables relative reduction of the C content (added C amount) because of ensuring the strength by the presence of Si and helps the steel to have better corrosion resistance and to thereby offer excellent delayed fracture resistance. The ratio ([Si]/[C]) is preferably 2.0 or more and more preferably 3.0 or more. Even when the steel has a ratio ([Si]/[C]) of 1.0 or more, the steel may disadvantageously suffer typically from deterioration in delayed fracture resistance and other properties if the steel has a chemical composition out of an appropriate range.

It is also effective to control the appropriate range of the ratio ([Si]/[C]) according to the C content. Specifically, (a) the ratio ([Si]/[C]) is preferably 2.0 or more at a C content of 0.23% to less than 0.25%; (b) the ratio ([Si]/[C]) is preferably 1.5 or more at a C content of 0.25% to less than 0.29%; and (c) the ratio ([Si]/[C]) is preferably 1.0 or more at a C content of 0.29% or more (namely 0.29% to less than 0.40%).

The steel according to the embodiment of the present invention should contain elements such as C, Si, Mn, P, S, Cr, V, Ti, B, Al, and N in contents controlled within appropriate ranges so as to have basic properties as steel. The contents of the elements are specified for reasons as follows.

Carbon (C) in a Content of 0.23% to Less than 0.40%

Carbon (C) element forms carbides and is essential for the steel to ensure a tensile strength necessary as a high strength steel. To exhibit the effects, carbon may be contained in a content of 0.23% or more. However, carbon, if contained in excess, may cause deterioration in toughness and corrosion resistance and cause the steel to have inferior delayed fracture resistance. To avoid such adverse effects of carbon, the C content should be less than 0.40%. The C content is preferably 0.25% or more and more preferably 0.27% or more in terms of lower limit; and is preferably 0.38% or less and more preferably 0.36% or less in terms of upper limit.

Silicon (Si) in a Content of 0.23% to 1.50%

Silicon (Si) element acts as a deoxidizer upon ingot making and is necessary as a solute element to strengthen the matrix. Si, when contained in a content of 0.23% or more, helps the steel to ensure a sufficient strength. In addition, Si, when added, causes carbides to be less soluble upon quenching, thereby contributes to better pinning effects, and suppresses grain coarsening. However, Si, if contained in an excessively high content greater than 1.50%, may cause the steel to have inferior cold workability even after spheroidization, may promote grain boundary oxidation in a heat treatment in quenching, and may cause the steel to have inferior delayed fracture resistance. The Si content is preferably 0.3% or more and more preferably 0.4% or more in terms of lower limit; and is preferably 1.0% or less and more preferably 0.8% or less in terms of upper limit.

Manganese (Mn) in a Content of 0.30% to 1.45%

Manganese (Mn) element improves hardenability and is important for the steel to have a high strength. Mn, when contained in a content of 0.30% or more, can exhibit the effects. However, Mn, if contained in an excessively high content, may acceleratedly segregate at grain boundaries to cause a lower grain boundary strength and may cause the steel to have inferior delayed fracture resistance contrarily. To prevent this, the upper limit of the Mn content is set to 1.45%. The Mn content is preferably 0.4% or more and more preferably 0.6% or more in terms of lower limit; and is preferably 1.3% or less and more preferably 1.1% or less in terms of upper limit.

Phosphorus (P) in a Content of 0.03% or Less (Excluding 0%)

Phosphorus (P) element is contained as an impurity. Phosphorus, if present in excess, may segregate at grain boundaries to cause a lower grain boundary strength and may cause the steel to have inferior delayed fracture properties. To prevent this, the upper limit of the P content is set to 0.03%. The P content is preferably 0.01% or less and more preferably 0.005% or less in terms of upper limit.

Sulfur (S) in a Content of 0.03% or Less (Excluding 0%)

Sulfur (S) element, if present in excess, may segregate as sulfides at grain boundaries to cause a lower grain boundary strength and may cause the steel to have inferior delayed fracture resistance. To prevent this, the upper limit of the S content is set to 0.03%. The S content is preferably 0.01% or less and more preferably 0.006% or less in terms of upper limit.

Chromium (Cr) in a Content of 0.05% to 1.5%

Chromium (Cr) element helps the steel to have better corrosion resistance and exhibits the effect when contained in a content of 0.05% or more. However, Cr, if contained in an excessively high content, may cause increased steel cost. To prevent this, the upper limit of the Cr content is set to 1.5%. The Cr content is preferably 0.10% or more and more preferably 0.13% or more in terms of lower limit; and is preferably 1.0% or less and more preferably 0.70% or less in terms of upper limit.

Vanadium (V) in a Content of 0.02% to 0.30%

Vanadium (V) element forms carbides/nitrides. Vanadium, when contained in a content of 0.02% or more in combination with Si, effectively contributes to grain refinement because carbide/nitride of vanadium become less soluble upon quenching. However, vanadium, if contained in a high content, may form coarse carbides/nitrides to cause the steel to have inferior cold forgeability. To prevent this, the upper limit of the vanadium content is set to 0.30%. The V content is preferably 0.03% or more and more preferably 0.04% or more in terms of lower limit; and is preferably 0.15% or less and more preferably 0.11% or less in terms of upper limit.

Titanium (E) in a Content of 0.02% to 0.1%

Titanium (E) element forms carbides/nitrides. Ti, when contained in a content of 0.02% or more, may contribute to grain refinement and may help the steel to have better toughness. In addition, Ti fixes nitrogen in steel as TiN (titanium nitride), thereby contributes to increase in free boron, and helps the steel to have better hardenability. However, Ti, if contained in an excessively high content greater than 0.1%, may cause the steel to have inferior workability. The Ti content is preferably 0.03% or more and more preferably 0.045% or more in terms of lower limit; and is preferably 0.08% or less and more preferably 0.065% or less in terms of upper limit.

Boron (B) in a Content of 0.0003% to 0.0050%

Boron (B) element effectively help the steel to have better hardenability. To exhibit the effect, boron should be contained in a content of 0.0003% or more in combination with Ti. However, boron, if contained in an excessively high content greater than 0.0050%, may cause the steel to have inferior toughness contrarily. The boron content is preferably 0.0005% or more and more preferably 0.001% or more in terms of lower limit; and is preferably 0.004% or less and more preferably 0.003% or less in terms of upper limit.

Aluminum (al) in a Content of 0.01% to 0.10%

Aluminum (Al) element is effective for steel deoxidation, forms AlN (aluminum nitride), and can thereby prevent austenitic grains from coarsening. Al also helps the steel to have better hardenability because this element fixes nitrogen and thereby contributes to increase in free boron. To exhibit the effects, the Al content is set to 0.01% or more. However, Al, if contained in an excessively high content greater than 0.10%, may exhibit saturated effects. The Al content is preferably 0.02% or more and more preferably 0.03% or more in terms of lower limit; and is preferably 0.08% or less and more preferably 0.05% or less in terms of upper limit.

Nitrogen (N) in a Content of 0.002% to 0.010%

Nitrogen (N) element is combined with Ti and V to form nitrides (TiN and VN) during a solidification process after ingot making. The element thereby contributes to grain refinement and helps the steel to have better delayed fracture resistance. Nitrogen effectively exhibits the effects when contained in a content of 0.002% or more. However, the nitrides such as TiN and VN, if formed in excessively large amounts, may fail to dissolve by heating at a temperature of around 1300° C. and may inhibit the formation of titanium carbide. Such excessive nitrogen may adversely affect delayed fracture properties contrarily and, if present in an excessively high content greater than 0.010%, may significantly impair delayed fracture properties. The nitrogen content is preferably 0.003% or more and more preferably 0.004% or more in terms of lower limit; and is preferably 0.008% or less and more preferably 0.006% or less in terms of upper limit.

Basic compositions in the high strength steel for bolt according to the embodiment of the present invention are as described above, with the remainder being iron and inevitable impurities (impurities other than P and S). Elements brought into the steel typically from raw materials, facility materials, and manufacturing facilities are accepted as the inevitable impurities. The boron-added high strength steel for bolt according to the embodiment of the present invention may advantageously further contain molybdenum (Mo) according to necessity in addition to the compositions (elements). The appropriate range and operation of Mo, when added, are as follows.

Molybdenum (Mo) in a Content of 0.10% or Less (Excluding 0%)

Molybdenum (Mo) element contributes to better hardenability, offers higher resistance to temper softening, and helps the steel to ensure a certain strength. However, Mo, if contained in an excessively high content, may cause an increased production cost. To prevent this, the Mo content is set to 0.10% or less. The Mo content is preferably 0.03% or more and more preferably 0.04% or more in terms of lower limit; and is preferably 0.07% or less and more preferably 0.06% or less in terms of upper limit.

The boron-added high strength steel for bolt having the chemical composition may be manufactured in the following manner so as to basically have a mixed microstructure of ferrite and pearlite (hereinafter also briefly referred to as "ferrite-pearlite") as a microstructure after rolling. Specifically, reheating of a billet before rolling is performed to 950° C. or higher; finish rolling of the billet is performed in a temperature range of 800° C. to 1000° C. to form a wire rod or bar steel; and then gradual cooling of the workpiece down to a temperature of 600° C. or lower is performed at an average cooling rate of 3° C./second or less.

Billet Reheating Temperature: 950° C. or Higher

The billet reheating should be performed so as to allow carbides/nitrides of Ti and V to dissolve in the austenite region, where the carbides/nitrides are effective for grain refinement. For this purpose, the billet reheating is preferably performed at a temperature of 950° C. or higher. The billet reheating, if performed at a temperature lower than 950° C., may cause insufficient dissolution of the carbides/nitrides. This may impede the formation of fine carbides/nitrides of Ti and V in subsequent hot rolling and may cause the carbides/nitrides to exhibit a lower grain refinement effect during quenching. The billet reheating temperature is more preferably 1000° C. or higher.

Finish rolling temperature: 800° C. to 1000° C.

The rolling should be performed so as to allow Ti and V, once dissolved upon billet reheating, to precipitate as fine carbides/nitrides in the steel. For this purpose, the finish rolling is preferably performed at a temperature of 1000° C. or lower. The finish rolling, if performed at a temperature higher than 1000° C., may cause the carbides/nitrides of Ti and V to less precipitate and to exhibit a lower grain refinement effect during quenching. In contrast, the finish rolling, if performed at an excessively low temperature, may cause a higher rolling load and the generation of surface flaws, thus being not practical. To prevent this, the finish rolling temperature is set to 800° C. or higher in terms of lower limit. The "finish rolling temperature" herein refers to an average surface temperature of the workpiece before a final rolling pass or before a reduction roll group, where the temperature is measurable with a radiation thermometer.

Average Cooling Rate after Rolling 3° C./Second or Less

It is important for the steel to have a ferrite-pearlite microstructure during cooling after rolling so as to improve formability in a downstream bolt forming process. For this purpose, cooling after rolling is preferably performed at an average cooling rate of 3° C./second or less. The cooling, if performed at an average cooling rate less than 3° C./second, may cause the formation of bainite and martensite and significantly adversely affect the bolt formability. The cooling is more preferably performed at an average cooling rate of 2° C./or less.

After performing a spheroidization treatment according to necessity or not, the boron-added high strength steel for bolt according to the embodiment of the present invention is formed into a bolt shape and then subjected to quenching and tempering treatments. This allows the steel to contain tempered martensite as its microstructure, to thereby ensure a predetermined tensile strength, and to offer excellent delayed fracture resistance. The quenching and tempering treatments may be performed under appropriate conditions as follows.

Heating in quenching is preferably performed to a temperature of 850° C. or higher for stable austenitizing. However, heating, if performed to an excessively high temperature higher than 920° C., may cause vanadium carbide/nitride to dissolve and to exhibit a lower pining effect. This may cause grains to coarsen and may cause the steel to have inferior delayed fracture properties contrarily. To prevent grain coarsening, heating in quenching is usefully performed to a temperature of 920° C. or lower. The heating temperature in quenching is preferably 900° C. or lower and more preferably 890° C. or lower in terms of upper limit; and is preferably 860° C. or higher and more preferably 870° C. or higher in terms of lower limit.

The boron-added high strength steel for bolt according to the embodiment of the present invention, as containing both V and Si, less suffers from dissolution of vanadium-containing precipitates upon quenching, helps the precipitates to exhibit a higher pinning effect, and thereby provides grain refinement. The bolt after quenching or after quenching and tempering therefore contains vanadium-containing precipitates (V-containing carbides, V-containing nitrides, and V-containing carbonitrides) as remained. The bolt preferably has a content of V in the precipitates (precipitates having a particle size of 0.1 μm or more) of 10% or more of the V content in the steel. Specifically, the bolt preferably has a VI value of 10% or more, where the VI value is specified by Expression (1) mentioned later. The bolt, when meeting the condition, can have still better delayed fracture resistance due to further grain refinement and hydrogen trapping effect. The VI value is more preferably 15% or more, and furthermore preferably 20% or more. Expression (1) is given as follows:

$$VI\ \text{value}(\%)=[(V\ \text{content in precipitates having a particle size of 0.1 μm or more})/(V\ \text{content in the steel})]\times 100 \quad (1)$$

The bolt as quenched has poor toughness and ductility, is not suitable as a bolt product without being treated, and should be subjected to a tempering treatment. Thus, the bolt is effectively subjected at least to a tempering treatment at a temperature of 350° C. or higher. However, tempering, if performed at a temperature higher than 550° C., may fail to help the steel having the chemical composition to ensure a tensile strength of 1100 MPa or more.

In the resulting bolt after quenching and tempering in the above manner, austenitic grains (prior austenitic grains) in the shank are preferably refined (allowed to have smaller grain sizes) for better delayed fracture resistance proportionally. A grain size number of austenitic grains in the bolt shank is preferably 8 or more, where the grain size number is determined according to Japanese Industrial Standard (JIS) G 0551. The grain size number is more preferably 9 or more, and furthermore preferably 10 or more.

TABLE 1

| | Chemical composition* (in mass percent) | | | | | | | | | | | | | Cooling rate [° C./sec] | Microstructure |
|---|---|---|---|---|---|---|---|---|---|---|---|---|---|---|---|
| Steel | C | Si | Mn | P | S | Cr | Mo | V | Ti | B | Al | N | [Si]/[C] | after rolling | after rolling |
| A | 0.24 | 0.49 | 0.91 | 0.009 | 0.010 | 0.16 | — | 0.052 | 0.051 | 0.0021 | 0.030 | 0.0027 | 2.04 | 2 | Ferrite-pearlite |
| B | 0.32 | 0.49 | 0.90 | 0.009 | 0.011 | 0.16 | — | 0.052 | 0.049 | 0.0020 | 0.030 | 0.0036 | 1.53 | 2 | Ferrite-pearlite |
| C | 0.24 | 1.02 | 0.89 | 0.012 | 0.015 | 0.30 | — | 0.103 | 0.070 | 0.0018 | 0.025 | 0.0039 | 4.25 | 2 | Ferrite-pearlite |
| D | 0.23 | 1.22 | 1.31 | 0.013 | 0.014 | 0.75 | — | 0.151 | 0.085 | 0.0021 | 0.054 | 0.0051 | 5.30 | 3 | Ferrite-pearlite |
| E | 0.37 | 0.85 | 0.50 | 0.009 | 0.013 | 1.38 | — | 0.057 | 0.030 | 0.0022 | 0.075 | 0.0078 | 2.30 | 2 | Ferrite-pearlite |
| F | 0.28 | 1.03 | 0.80 | 0.018 | 0.018 | 0.13 | — | 0.041 | 0.053 | 0.0019 | 0.033 | 0.0040 | 3.68 | 3 | Ferrite-pearlite |
| G | 0.25 | 1.35 | 0.35 | 0.010 | 0.011 | 0.15 | 0.07 | 0.055 | 0.053 | 0.0019 | 0.035 | 0.0035 | 5.40 | 2 | Ferrite-pearlite |
| H | 0.32 | 0.75 | 0.82 | 0.015 | 0.017 | 0.08 | 0.05 | 0.069 | 0.055 | 0.0015 | 0.039 | 0.0045 | 2.34 | 2 | Ferrite-pearlite |
| I | 0.15 | 0.35 | 0.79 | 0.015 | 0.016 | 0.51 | — | 0.083 | 0.070 | 0.0020 | 0.032 | 0.0045 | 2.33 | 2 | Ferrite-pearlite |
| J | 0.45 | 1.03 | 0.38 | 0.018 | 0.011 | 0.32 | — | 0.064 | 0.073 | 0.0015 | 0.035 | 0.0052 | 2.29 | 2 | Ferrite-pearlite |
| K | 0.24 | 0.18 | 0.92 | 0.008 | 0.010 | 0.16 | — | 0.052 | 0.052 | 0.0020 | 0.030 | 0.0036 | 0.75 | 2 | Ferrite-pearlite |
| L | 0.35 | 0.23 | 0.92 | 0.013 | 0.014 | 0.18 | — | 0.053 | 0.051 | 0.0013 | 0.038 | 0.0040 | 0.66 | 2 | Ferrite-pearlite |
| M | 0.27 | 0.22 | 0.99 | 0.010 | 0.012 | 0.32 | — | 0.050 | 0.051 | 0.0018 | 0.050 | 0.0044 | 0.81 | 2 | Ferrite-pearlite |
| N | 0.23 | 0.22 | 1.03 | 0.014 | 0.015 | 0.30 | — | 0.038 | 0.055 | 0.0019 | 0.035 | 0.0031 | 0.96 | 3 | Ferrite-pearlite |
| O | 0.37 | 0.32 | 1.10 | 0.015 | 0.011 | 0.42 | — | 0.055 | 0.042 | 0.0022 | 0.029 | 0.0041 | 0.86 | 2 | Ferrite-pearlite |
| P | 0.24 | 0.38 | 0.21 | 0.017 | 0.018 | 0.42 | — | 0.051 | 0.044 | 0.0018 | 0.030 | 0.0040 | 1.58 | 3 | Ferrite-pearlite |
| Q | 0.25 | 1.25 | 1.88 | 0.011 | 0.013 | 0.50 | — | 0.055 | 0.030 | 0.0020 | 0.030 | 0.0042 | 5.00 | 2 | Ferrite-pearlite |
| R | 0.27 | 0.85 | 0.80 | 0.038 | 0.015 | 0.17 | — | 0.061 | 0.030 | 0.0017 | 0.028 | 0.0041 | 3.15 | 3 | Ferrite-pearlite |
| S | 0.30 | 0.99 | 0.81 | 0.020 | 0.035 | 0.18 | — | 0.044 | 0.038 | 0.0014 | 0.033 | 0.0050 | 3.30 | 3 | Ferrite-pearlite |
| T | 0.24 | 0.55 | 0.99 | 0.018 | 0.020 | — | — | 0.048 | 0.025 | 0.0018 | 0.051 | 0.0029 | 2.29 | 2 | Ferrite-pearlite |
| U | 0.25 | 0.47 | 0.96 | 0.003 | 0.006 | 0.31 | — | 0.013 | 0.052 | 0.0013 | 0.029 | 0.0049 | 1.88 | 2 | Ferrite-pearlite |
| V | 0.29 | 1.10 | 0.85 | 0.017 | 0.017 | 0.72 | — | 0.308 | 0.073 | 0.0016 | 0.055 | 0.0051 | 3.79 | 2 | Ferrite-pearlite |
| W | 0.30 | 1.08 | 0.80 | 0.014 | 0.019 | 0.78 | — | 0.183 | — | 0.0020 | 0.053 | 0.0063 | 3.60 | 2 | Ferrite-pearlite |
| X | 0.33 | 1.02 | 0.82 | 0.022 | 0.019 | 0.50 | — | 0.210 | 0.181 | 0.0017 | 0.033 | 0.0060 | 3.09 | 2 | Ferrite-pearlite |
| Y | 0.37 | 0.65 | 1.41 | 0.011 | 0.014 | 1.42 | — | 0.185 | 0.051 | 0.0023 | 0.004 | 0.0041 | 1.76 | 5 | Rich in bainite |

*The remainder being iron and inevitable impurities other than P and S

EXAMPLES

The present invention will be illustrated in further detail with reference to several examples below. It should be noted, however, that the examples are by no means intended to limit the scope of the invention; that various changes and modifications can naturally be made therein without deviating from the spirit and scope of the invention as described above and below; and all such changes and modifications should be considered to be within the scope of the invention.

Ingots of steels (Steels A to Y) having chemical compositions given in Table 1 below were made, subjected to rolling (at a billet reheating temperature of 1000° C. and a finish rolling temperature of 800° C.), and yielded wire rods having a diameter of 14 mm. Microstructures of the individual wire rods after rolling are also indicated in Table 1. The rolled steels were subjected sequentially to a descaling-coating treatment, wire drawing, spheroidization, another descaling-coating treatment, and finish wire drawing. In Table 1, an element indicated with "-" is not added.

Microstructure observation was performed by embedding a cross section of a sample rolled steel in a resin, and observing the cross section at a position of one fourth the diameter (D/4) of the wire rod with a scanning electron microscope (SEM). A sample as indicated with "ferrite-pearlite" in the microstructure after rolling in Table 1 is one having a content of phases other than ferrite and pearlite of 10 percent by area or less. A sample as indicated with "rich in bainite" in the microstructure after rolling in Table 1 is one having a bainite content of greater than 10 percent by area. In Steel S, bainite occupied up to about 20% of the microstructure after rolling.

The resulting steel wires were subjected to cold heading using a parts former and yielded flange bolts having dimensions of M12×1.25 P and a length of 100 mm. The bolt formability (cold headability) was evaluated by whether cracking occurred or not in the flange. In Table 3 below, a sample having cracking in the flange was evaluated as having poor bolt formability and is indicated with "x"; whereas a sample having no cracking in the flange was evaluated as having good bolt formability and is indicated with "○". Next, the flange bolts were subjected to quenching and tempering under conditions given in Table 2 below. Other conditions in quenching and tempering are as follows: a heating time in quenching of 20 minutes; a quenching in-furnace atmosphere of air, a quenching cooling condition of oil cooling (70° C.); a heating time in tempering of 30 minutes; a tempering in-furnace atmosphere of air, and a tempering cooling condition of oil cooling (25° C.).

The bolts after quenching and tempering were examined to measure or evaluate the VI value, shank grain size, tensile strength, corrosion resistance, and delayed fracture resistance.

(1) VI Value Measurement

The V content in precipitates contained in the bolt and having a particle size of 0.1 μm or more was measured by an extracted residue analysis. In the analysis, the V content in precipitates was measured on a sample bolt after quenching (before tempering). This is because the V content in precipitates is changed little between after quenching (but before tempering) and after tempering and quenching, when tempering is performed under conditions as given in Table 2. The V content in precipitates was measured by subjecting a sample bolt after quenching to electrolytic extraction with a 10% acetylacetone solution to give a residue; collecting precipitates from the residue using a mesh having an opening size of 0.1-μm; and measuring the V content in the precipitates by inductively coupled plasma-atomic emission spectroscopy (IPC-AES). The VI value was determined according to Expression (1) by dividing the V content in precipitates by the V content in the steel (total V amount in the entire steel) and multiplying the resulting value by 100.

(2) Austenitic Grain Size Measurement

A sample bolt shank was cut at a cross section (cross section perpendicular to the bolt axis), an arbitrary 0.039-$mm^2$ area of the cross section at a position one fourth the shank diameter (D/4) was observed with an optical microscope at a magnification of 400 folds, based on which a grain size number was measured according to JIS G0551. The measurement was performed on four fields of view, the resulting values were averaged, and the average was defined as an austenitic grain size number. A sample having a grain size number of 8 or more was evaluated as accepted ("○").

(3) Tensile Strength Measurement

The tensile strength of a sample bolt was measured by a tensile test according to JIS B1051. A sample having a tensile strength of 1100 MPa or more was evaluated as accepted.

(4) Corrosion Resistance Evaluation

A sample bolt was immersed in a 15% HCl aqueous solution (hydrochloric acid) for 30 minutes, a weight loss on corrosion between before and after the immersion was determined, and evaluated as the corrosion resistance.

(5) Delayed Fracture Resistance Evaluation

The delayed fracture resistance was evaluated in the following manner. A sample bolt was immersed in a 15% HCl aqueous solution for 30 minutes, rinsed, dried, applied with a constant load, a load at which the sample did not break in 100 hours or longer was determined, and the load was compared. In this process, the load at which the sample after acid immersion did not break in 100 hours or longer was divided by a peak load in a tensile test of the sample bolt without acid immersion, and the resulting value was defined as a delayed fracture-strength ratio. A sample having a value (delayed fracture-strength ratio) of 0.70 or more was determined as accepted.

The results are indicated in combination with the quenching and tempering conditions and the microstructure after quenching and tempering in Table 2 as follows.

TABLE 2

| Test No. | Steel | Quenching temperature (° C.) | Tempering temperature (° C.) | VI value | Bolt formability | Tensile strength [MPa] | Grain size | Loss on corrosion (%) | Delayed fracture-strength ratio | Microstructure after quenching and tempering |
|---|---|---|---|---|---|---|---|---|---|---|
| 1 | A | 870 | 380 | 22 | no cracking | 1203 | 10.8 | 0.118 | 0.88 | tempered martensite |
| 2 | A | 900 | 380 | 18 | no cracking | 1251 | 8.7 | 0.111 | 0.73 | tempered martensite |
| 3 | A | 920 | 380 | 10 | no cracking | 1252 | 8.0 | 0.110 | 0.70 | tempered martensite |
| 4 | B | 870 | 420 | 24 | no cracking | 1334 | 9.8 | 0.093 | 0.75 | tempered martensite |
| 5 | B | 900 | 420 | 8 | no cracking | 1340 | 7.5 | 0.090 | 0.71 | tempered martensite |
| 6 | C | 880 | 430 | 30 | no cracking | 1256 | 10.8 | 0.082 | 0.89 | tempered martensite |
| 7 | C | 900 | 430 | 25 | no cracking | 1261 | 10.2 | 0.077 | 0.82 | tempered martensite |
| 8 | C | 920 | 430 | 17 | no cracking | 1265 | 8.8 | 0.075 | 0.75 | tempered martensite |
| 9 | D | 880 | 430 | 32 | no cracking | 1324 | 11.2 | 0.093 | 0.92 | tempered martensite |
| 10 | E | 880 | 420 | 24 | no cracking | 1553 | 9.6 | 0.081 | 0.72 | tempered martensite |
| 11 | F | 880 | 410 | 25 | no cracking | 1297 | 10.4 | 0.113 | 0.85 | tempered martensite |
| 12 | G | 880 | 410 | 35 | no cracking | 1322 | 11.5 | 0.075 | 0.92 | tempered martensite |
| 13 | H | 880 | 400 | 19 | no cracking | 1341 | 9.8 | 0.122 | 0.79 | tempered martensite |
| 14 | I | 870 | 380 | 15 | no cracking | 879 | 8.4 | — | — | ferrite-pearlite |
| 15 | J | 880 | 500 | 23 | no cracking | 1440 | 10.2 | 0.121 | 0.55 | tempered martensite |
| 16 | K | 870 | 380 | 7 | no cracking | 1087 | 7.6 | 0.125 | 0.63 | tempered martensite |
| 17 | L | 880 | 390 | 8 | no cracking | 1369 | 7.8 | 0.175 | 0.42 | tempered martensite |
| 18 | M | 880 | 390 | 6 | no cracking | 1123 | 7.5 | 0.113 | 0.41 | |
| 19 | N | 880 | 390 | 7 | no cracking | 1121 | 7.8 | 0.101 | 0.48 | tempered martensite |
| 20 | O | 870 | 390 | 12 | no cracking | 1248 | 8.0 | 0.162 | 0.60 | tempered martensite |
| 21 | P | 870 | 400 | 11 | no cracking | 1025 | 8.5 | — | — | tempered martensite |
| 22 | Q | 880 | 410 | 17 | no cracking | 1299 | 8.7 | 0.130 | 0.62 | tempered martensite |
| 23 | R | 880 | 400 | 20 | no cracking | 1290 | 9.8 | 0.138 | 0.31 | tempered martensite |
| 24 | S | 880 | 400 | 22 | no cracking | 1282 | 9.6 | 0.149 | 0.35 | tempered martensite |
| 25 | T | 870 | 380 | 18 | no cracking | 1193 | 9.2 | 0.182 | 0.51 | tempered martensite |
| 26 | U | 870 | 380 | 6 | no cracking | 1234 | 7.8 | 0.111 | 0.59 | tempered martensite |
| 27 | V | — | — | — | cracking | — | — | — | — | — |
| 28 | W | 880 | 410 | 5 | no cracking | 1239 | 7.2 | 0.091 | 0.63 | tempered martensite |
| 29 | X | — | — | — | cracking | — | — | — | — | — |
| 30 | Y | — | — | — | cracking | — | — | — | — | — |

The results give considerations as follows. Test Nos. 1 to 13 were samples (examples) meeting conditions [chemical composition, ratio ([Si]/[C]), and microstructure] specified in the present invention and found to exhibit a high strength and excellent delayed fracture resistance. Among them, the results of Test Nos. 1 to 3 and 6 to 8 demonstrate how the VI value affected the properties. Specifically, the samples were found to include finer grains and have better delayed fracture resistance with an increasing VI value.

In contrast, Test Nos. 14 to 30 were samples not meeting at least one of the conditions specified in the present invention and were inferior in any of the properties. Specifically, Test No. 14 was a sample using a steel (Steel I) having an excessively low C content and failed to have a high strength by a regular heat treatment. No. 15 was a sample using a steel (Steel J) having an excessively high C content and suffered from inferior delayed fracture resistance due to low toughness.

Test No. 16 was a sample using a steel (Steel K) having an excessively low Si content and also having a ratio [Si]/[C] of less than 1.0, failed to have a high strength by a regular heat treatment, and underwent insufficient grain refinement. Test Nos. 17 to 20 were samples using steels (Steels L, M, N, and O) having individual element contents meeting the conditions, but having a ratio [Si]/[C] of less than 1.0, exhibited inferior corrosion resistance, and offered poor delayed fracture-strength ratios.

Test No. 21 was a sample using a steel (Steel P) having an excessively low Mn content and failed to attain a high strength (other evaluations were not performed). Test No. 22 was a sample using a steel (Steel Q) having an excessively high Mn content, suffered from a lower grain boundary strength due to segregation, and offered inferior delayed fracture resistance.

Test No. 23 was a sample using a steel (Steel R) having an excessively high P content, suffered from a low grain boundary strength due to grain boundary segregation of phosphorus, and offered inferior delayed fracture resistance. Test No. 24 was a sample using a steel (Steel S) having an excessively high S content, suffered from a low grain boundary strength due to grain boundary segregation of sulfides, and offered inferior delayed fracture resistance.

Test No. 25 was a sample using a steel (Steel T) without the addition of Cr and suffered from inferior corrosion resistance and poor delayed fracture resistance. Test No. 26 was a sample using a steel (Steel U) having an excessively low V content, underwent insufficient grain refinement, and thereby had inferior toughness and poor delayed fracture resistance. Test No. 27 was a sample using a steel (Steel V) having an excessively high V content, underwent the formation of coarse carbides/nitrides, and thereby suffered from inferior cold headability (bolt formability) (other evaluations were not performed).

Test No. 28 was a sample using a steel (Steel W) without the addition of Ti, suffered from inferior hardenability due to the formation of BN (boron nitride), and offered poor delayed fracture resistance. Test No. 29 was a sample using a steel (Steel X) having an excessively high Ti content, underwent the formation of coarse carbides/nitrides, and thereby suffered from inferior cold headability (bolt formability) (other evaluations were not performed).

Test No. 30 was a sample undergoing post-rolling cooling at an excessively high cooling rate greater than 3° C./second and giving a rolled wire rod having a microstructure rich in bainite, failed to have a sufficiently lowered hardness even after spheroidization, and thereby suffered from inferior cold forgeability. Results of the evaluations are indicated all together in Table 3 below. The evaluation results are indicated with "○" when evaluated as good; indicated with "x" when evaluated as inferior (poor); and indicated with "-" when not evaluated.

TABLE 3

| Test No. | Steel | Bolt formability | Tensile strength | Grain size | Corrosion resistance | Delayed fracture resistance |
|---|---|---|---|---|---|---|
| 1 | A | ○ | ○ | ○ | ○ | ○ |
| 2 | A | ○ | ○ | ○ | ○ | ○ |
| 3 | A | ○ | ○ | ○ | ○ | ○ |
| 4 | B | ○ | ○ | ○ | ○ | ○ |
| 5 | B | ○ | ○ | ○ | ○ | ○ |
| 6 | C | ○ | ○ | ○ | ○ | ○ |
| 7 | C | ○ | ○ | ○ | ○ | ○ |
| 8 | C | ○ | ○ | ○ | ○ | ○ |
| 9 | D | ○ | ○ | ○ | ○ | ○ |
| 10 | E | ○ | ○ | ○ | ○ | ○ |
| 11 | F | ○ | ○ | ○ | ○ | ○ |
| 12 | G | ○ | ○ | ○ | ○ | ○ |
| 13 | H | ○ | ○ | ○ | ○ | ○ |
| 14 | I | ○ | x | ○ | — | — |
| 15 | J | ○ | ○ | ○ | ○ | x |
| 16 | K | ○ | x | x | ○ | x |
| 17 | L | ○ | ○ | x | x | x |
| 18 | M | ○ | ○ | x | ○ | x |
| 19 | N | ○ | ○ | x | ○ | x |
| 20 | O | ○ | ○ | ○ | x | x |
| 21 | P | ○ | x | ○ | — | — |
| 22 | Q | ○ | ○ | ○ | x | x |
| 23 | R | ○ | ○ | ○ | ○ | x |
| 24 | S | ○ | ○ | ○ | ○ | x |
| 25 | T | ○ | ○ | ○ | x | x |
| 26 | U | ○ | ○ | x | ○ | x |
| 27 | V | x | — | — | — | — |
| 28 | W | ○ | ○ | x | ○ | x |
| 29 | X | x | — | — | — | — |
| 30 | Y | x | — | — | — | — |

FIG. 1 illustrates how the ratio [Si]/[C] affects the tensile strength and delayed fracture-strength ratio in Test Nos. 1 to 13 (Examples) and Test Nos. 16 to 20 (Comparative Examples). The results demonstrate that steels, when having a ratio [Si]/[C] controlled within an appropriate range, can effectively have excellent delayed fracture resistance even when having a tensile strength of 1100 MPa or more.

The invention claimed is:

1. A high strength bolt, obtained by a process comprising:

forming a bolt-shaped workpiece using a steel, the steel comprising: by mass %, from 0.23% to less than 0.40% of C;

from 0.23% to 1.50% of Si;

0.03% or less, excluding 0%, of P;

0.03% or less, excluding 0%, of S;

from 0.05% to 1.5% of Cr;

from 0.02% to 0.30% of V;

from 0.02% to 0.1% of Ti;

from 0.0003% to 0.0050% of B;

from 0.01% to 0.10% of Al; and from 0.002% to 0.010% of N, with the remainder being iron and inevitable impurities;

wherein the steel has a ratio [Si]/[C] of 1.0 or more, wherein [Si] and [C] represent a content of Si and a content of C, respectively; and wherein the steel has a mixed microstructure of ferrite and pearlite;

subjecting the bolt-shaped workpiece to a quenching treatment; and subjecting the bolt-shaped workpiece after quenching to a tempering treatment, wherein the bolt has a tensile strength of 1100 MPa or more, and wherein a VI value is 10% or more, where the VI value is determined from a V content in precipitates having a particle size of 0.1 μm or more and a V content in the steel and specified by the following Expression (1):

$$VI\ \text{value}(\%)=[(V\ \text{content in precipitates having a particle size of 0.1 μm or more})/(V\ \text{content in the steel})]\times 100 \quad (1).$$

2. The high strength bolt of claim 1, wherein an austenitic grain size number of a bolt shank after quenching and tempering is 8 or more.

3. The high strength bolt of claim 1, wherein the bolt-shaped workpiece is subjected to a quenching treatment while heating the bolt-shaped workpiece to 850° C. to 920° C.

4. The high strength bolt according to claim 1, the steel further comprises, by mass %, 0.10% or less, excluding 0% of Mo.

* * * * *